US012546483B2

(12) United States Patent
Zhang et al.

(10) Patent No.: US 12,546,483 B2
(45) Date of Patent: Feb. 10, 2026

(54) DECORATIVE GAS STOVE

(71) Applicant: SHINERICH INDUSTRIAL LTD., Shenzhen (CN)

(72) Inventors: Guangrong Zhang, Shenzhen (CN); Hui Peng, Shenzhen (CN)

(73) Assignee: SHINERICH INDUSTRIAL LTD., Shenzhen (CN)

( * ) Notice: Subject to any disclaimer, the term of this patent is extended or adjusted under 35 U.S.C. 154(b) by 365 days.

(21) Appl. No.: 18/305,602

(22) Filed: Apr. 24, 2023

(65) Prior Publication Data

US 2024/0240798 A1 Jul. 18, 2024

Related U.S. Application Data

(63) Continuation of application No. PCT/CN2023/083945, filed on Mar. 27, 2023.

(30) Foreign Application Priority Data

Jan. 16, 2023 (CN) ..... 202310057093.0

(51) Int. Cl.
*F24C 15/06* (2006.01)
*F24C 3/02* (2021.01)
(Continued)

(52) U.S. Cl.
CPC ..... *F24C 15/06* (2013.01); *F24C 3/103* (2013.01); *F24C 3/122* (2013.01); *F24C 15/18* (2013.01); *F24C 3/022* (2013.01)

(58) Field of Classification Search
CPC ..... F24C 15/06; F24C 15/18; F24C 3/103; F24C 3/122; F24C 3/022
(Continued)

(56) References Cited

U.S. PATENT DOCUMENTS 3,830,217 A 8/1974 Maness et al.
6,192,881 B1 * 2/2001 Nix ..... F24C 3/14 431/126
(Continued)

FOREIGN PATENT DOCUMENTS

CN 201028517 Y 2/2008
CN 101573064 A 11/2009
(Continued)

OTHER PUBLICATIONS

Extended European Search Report issued in counterpart European Patent Application No. 23711925.0, dated Dec. 13, 2024.
(Continued)

*Primary Examiner* — Vivek K Shirsat
(74) *Attorney, Agent, or Firm* — Westbridge IP LLC

(57) ABSTRACT

Disclosed is a decorative gas stove. The decorative gas stove includes a stove body and a viewing platform. A cavity is defined in the stove body. An energy device is provided inside the cavity for storing gaseous fuel. A supply pipe is provided inside the cavity for transporting the gaseous fuel. A water tank is provided on an upper end of the stove body and a bottom of the water tank is defined with a plurality of air outlet holes communicated with the supply pipe. An ignition portion is provided on a side wall of the water tank for igniting the gaseous fuel flowing to a water surface through the air outlet holes when the water tank is stored with water.

8 Claims, 4 Drawing Sheets

(51) Int. Cl.
*F24C 3/10* (2006.01)
*F24C 3/12* (2006.01)
*F24C 15/18* (2006.01)

(58) Field of Classification Search
USPC ..... 126/85 R
See application file for complete search history.

(56) References Cited

U.S. PATENT DOCUMENTS

| | | | | |
|---|---|---|---|---|
| 6,790,033 | B2 * | 9/2004 | Grady | F24B 1/192 239/18 |
| 2002/0124814 | A1 * | 9/2002 | Stretch | F24H 9/205 122/14.1 |
| 2007/0207429 | A1 | 9/2007 | Barker | |
| 2024/0369227 | A1 * | 11/2024 | Burch | F24B 1/181 |

FOREIGN PATENT DOCUMENTS

| | | | |
|---|---|---|---|
| CN | 108036361 | A | 5/2018 |
| CN | 207561578 | U | 7/2018 |
| CN | 209484662 | U | 10/2019 |
| CN | 215570452 | U | 1/2022 |
| CN | 115031235 | A | 9/2022 |
| CN | 217357039 | U | 9/2022 |
| CN | 217635765 | U | 10/2022 |
| GB | 191510250 | A | 7/1916 |
| JP | H08252380 | A | 10/1996 |
| JP | 2002115797 | A | 4/2002 |

OTHER PUBLICATIONS

First Office Action issued in counterpart Chinese Patent Application No. 202310057093.0, dated Oct. 25, 2023.

International Search Report and Written Opinion issued in corresponding PCT Application No. PCT/CN2023/083945, dated Sep. 8, 2023.

* cited by examiner

DECORATIVE GAS STOVE

CROSS-REFERENCE TO RELATED APPLICATIONS

This application is a continuation application of International Application No. PCT/CN2023/083945, filed on Mar. 27, 2023, which claims priority to Chinese Patent Application No. 202310057093.0, filed on Jan. 16, 2023. The disclosures of the above-mentioned applications are incorporated herein by reference in their entireties.

TECHNICAL FIELD

The present disclosure relates to the technical field of stoves, and in particular, to a decorative gas stove.

BACKGROUND

As people's material life becomes wealthy, their pursuit of spirituality is growing day by day. Stoves are normally used for heating people or objects. In addition to that, people are more concerned about their value as a new ornamental object. At present, there have appeared many kinds of decorative stoves. For example, some stoves adopt volcanic stone, broken glass and others as the stove media to make the burning state of the flowing gas closer to the natural flame by burning wood. Some stoves are placed in front of the water features as decorations. Furthermore, there are even some stoves with a burning area in the middle surrounded by flowing water, which is designed to simulate a fire in water for displaying unique ornamental features.

In fact, whether the stoves placed in front of the water features or the stoves with water surrounding the burning area, have an ornamental value to some extent, but still cannot reach the real ornamental effect of the flame burning on the water.

SUMMARY

The present disclosure mainly aims to provide a decorative gas stove to solve the existing technical problem that the existing stoves cannot reach a vivid viewing effect of the flame burning on the water.

In order to achieve the above objective, the present disclosure provides a decorative gas stove. The decorative gas stove includes a stove body and a viewing platform. A cavity is defined in the stove body. An energy device is provided inside the cavity for storing gaseous fuel. A supply pipe is provided inside the cavity for transporting the gaseous fuel. A water tank is provided on an upper end of the stove body and a bottom of the water tank is defined with a plurality of air outlet holes communicated with the supply pipe. An ignition portion is provided on a side wall of the water tank for igniting the gaseous fuel flowing to a water surface through the air outlet holes when the water tank is stored with water.

In some embodiments, the decorative gas stove further includes an anti-backflow structure configured to prevent the water in the water tank from flowing back to the supply pipe, the anti-backflow structure includes:

- a gas supply cavity provided under the bottom of the water tank and communicated with the supply pipe and the air outlet holes;
- a movable plugging portion provided inside the gas supply cavity and configured to move to a plugging position for plugging the air outlet holes and to move to an avoidance position for communicating the supply pipe and the air outlet holes, the movable plugging portion being pushed from the plugging position to the avoidance position by the gaseous fuel when the energy device outputs the gaseous fuel into the gas supply cavity; and
- a reset portion provided inside the gas supply cavity and opposite to the supply pipe, the reset portion being configured to push the movable plugging portion from the avoidance position to the plugging position when the energy device stops supplying gaseous fuel.

In some embodiments, the anti-backflow structure further includes a limiting portion provided inside the gas supply cavity and located at the plugging position, and the limiting portion is configured to resist and restrict the movable plugging portion at the plugging position when the reset portion pushes the movable plugging portion to move.

In some embodiments, the energy device includes a high pressure gas-supply system communicated with the supply pipe and configured to depressurize the gaseous fuel.

In some embodiments, the water tank is defined with an overflow hole configured to drain the water from the water tank to an outside, and a height of the overflow hole is less than a height of the ignition portion.

In some embodiments, the decorative gas stove further includes:

- a solenoid valve provided on the supply pipe for dividing the supply pipe into a plurality of supply branches, the ignition portion being communicated with part of the supply branches; and
- a pulse igniter configured to ignite the gaseous fuel flowing from the ignition portion.

In some embodiments, each of the air outlet holes is respectively communicated with each of the supply branches, and

- the decorative gas stove further includes a regulative switch configured to control the energy device to output the gaseous fuel to each of the supply branches for adjusting an amount of the gaseous fuel flowing from the air outlet holes.

In some embodiments, the stove body further includes a storage table provided at the upper end of the stove body, a center of the storage table is defined with an installation port for installing the water tank, and a side of the storage table is provided with a storage area for placing objects.

In some embodiments, a viewing glass for firebreak is provided on the storage table and around the installation port, the viewing glass includes:

- four pieces of glass; and
- a glass assembly portion provided between each two adjacent pieces of glass to assemble the four pieces of glass into one piece of glass.

In some embodiments, a thermal insulation structure is provided on a side of the viewing glass away from the water tank; and/or

- a fixing block is provided on the storage table for fixing the water tank to the installation port, and the fixing block protrudes out of an upper end of the storage table and abuts a lower end of the viewing glass for restricting an installation position of the viewing glass.

In the technical solution of the present disclosure, a plurality of air outlet holes communicated with the supply pipe of the energy device are provided at the bottom of the water tank. When water is put into the water tank and the stove is turned on, the energy device delivers gaseous fuel to the air outlet holes through the supply pipe, the gaseous fuel escapes from the bottom of the water tank to the water surface, and the gas fuel escaping to the water surface is ignited by the ignition portion. Thus, the gaseous fuel burns on the water surface and produces flame, thereby achieving the ornamental effect of flame burning on water.

BRIEF DESCRIPTION OF THE DRAWINGS

In order to more clearly illustrate the technical solutions in the embodiments of the present disclosure or in the related art, drawings in the embodiments or in the related art will be briefly described below. Obviously, the drawings in the following description are only some embodiments of the present disclosure. Other drawings can be obtained by those skilled in the art according to the structures shown in the drawings without creative work.

Figure 1:
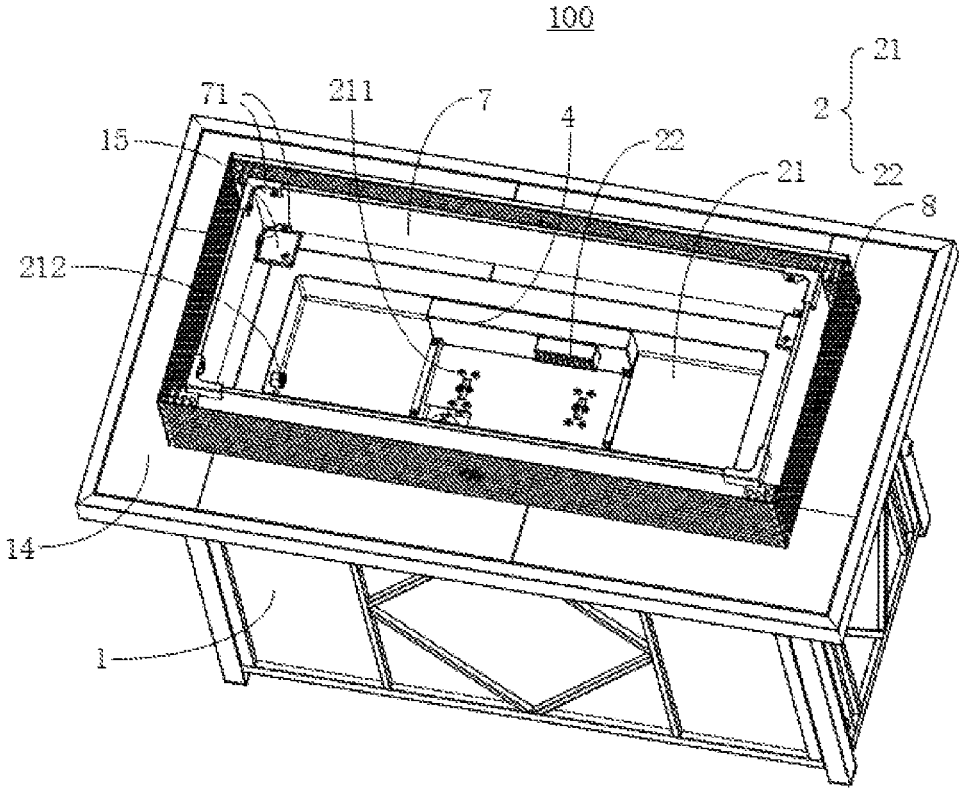
FIG. 1 is a stereoscopic schematic view of a decorative gas stove according to some embodiments of the present disclosure.

The realization of the objective, functional characteristics, and advantages of the present disclosure are further described with reference to the accompanying drawings.

DETAILED DESCRIPTION OF THE EMBODIMENTS

The technical solutions of embodiments of the present disclosure will be clearly and completely described with reference to the drawings of the present disclosure. Obviously, the described embodiments are only some rather than all of the embodiments of the present disclosure. Based on the embodiments of the present disclosure, all other embodiments obtained by those skilled in the art without creative efforts shall fall within the scope of the present disclosure.

It should be noted that all directional indicators (such as up, down, left, right, front, rear, etc.) in the embodiments of the present disclosure are only used to explain the relative positional relationship, movement situation, etc. among components in a specific attitude (as shown in the drawings). If the specific attitude changes, the directional indication also changes accordingly.

In addition, the descriptions related to "first", "second" and the like in the present disclosure are merely for descriptive purposes, and should not be understood as indicating or implying their relative importance or implicitly indicating the number of technical features indicated. Therefore, the features defined by "first" and "second" may explicitly or implicitly include at least one such feature. Besides, the various embodiments can be combined with each other, but the combination must be based on what can be achieved by those skilled in the art. When the combination of the embodiments is contradictory or cannot be achieved, it should be considered that such combination does not exist, or is not within the scope of the present disclosure.

As people's material life become wealthy, their pursuit of spirituality is growing day by day. Stoves are normally used for heating people or objects. In addition to that, people are more concerned about their value as a new ornamental object. At present, there have appeared many kinds of decorative stoves. For example, some stoves adopt volcanic stone, broken glass and others as the stove media to make the burning state of the flowing gas closer to the natural flame by burning wood. Some stoves are placed in front of the water features as decorations. Furthermore, there are even some stoves with a burning area in the middle surrounded by flowing water, which is designed to simulate a fire in water for displaying unique ornamental features.

In fact, whether the stoves placed in front of the water features or the stoves with water surrounding the burning area, have an ornamental value to some extend, but still cannot reach the real ornamental effect of the flame burning on the water.

In order to solve the above mentioned problems, the disclosure provides a decorative gas stove. FIGS. 1-5 are drawings according to some embodiments of the present disclosure.

In some embodiments of the present disclosure (hereinafter some embodiments), as shown in FIGS. 1-5, the decorative gas stove 100 includes a stove body 1 and a viewing platform 2. A cavity 11 is defined in the stove body 1. An energy device 12 is provided inside the cavity 11 for storing gaseous fuel. A supply pipe 13 is provided inside the cavity 11 for transporting the gaseous fuel. A water tank 21 is provided on an upper end of the stove body 1 and a bottom of the water tank 21 is defined with a plurality of air outlet holes 211 communicated with the supply pipe 13. An ignition portion 22 is provided on a side wall of the water tank 21 for igniting the gaseous fuel flowing to a water surface through the air outlet holes 211 when the water tank 21 is stored with water.

In the technical solution of the present disclosure, a plurality of air outlet holes 211 communicated with the supply pipe 13 of the energy device 12 are provided at the bottom of the water tank 21. When water is put into the water tank 21 and the stove is turned on, the energy device 12 delivers gaseous fuel to the air outlet holes 211 through the supply pipe 13, the gaseous fuel escapes from the bottom of the water tank 21 to the water surface, and the gas fuel escaping to the water surface is ignited by the ignition portion 22. Thus, the gaseous fuel burns on the water surface and produces flame, thereby achieving the ornamental effect of flame burning on water.

In order to prevent the water in the water tank 21 from flowing back to the solenoid valve 4 and the supply pipe 13, the anti-backflow structure 3 includes a gas supply cavity 31, a movable plugging portion 32 and a reset portion 33. The gas supply cavity 31 is provided under the bottom of the water tank 21 and communicated with the supply pipe 13 and the air outlet holes 211. The movable plugging portion 32 is provided inside the gas supply cavity 31 and configured to move to a plugging position for plugging the air outlet holes 211 and to move to an avoidance position for communicating the supply pipe 13 and the air outlet holes 211. When the movable plugging portion 32 is located at the plugging position, the movable plugging portion 32 may plug the air outlet holes 211 when the gaseous fuel is not transported, thereby to prevent water from flowing back to the gas supply cavity 31. When the plugging portion is located at the avoidance position, the air outlet holes 211 are not blocked by the plugging portion, and the gaseous fuel may escape to the water surface from the air outlet holes 211. The movable plugging portion 32 is pushed from the plugging position to the avoidance position by the gaseous fuel due to the high pressure of gaseous fuel, when the energy device 12 outputs the gaseous fuel into the gas supply cavity 31, thereby to supplying the gaseous fuel. The reset portion 33 is provided inside the gas supply cavity 31 and opposite to the supply pipe 13. The reset portion 33 is configured to push the movable plugging portion 32 from the avoidance position to the plugging position when the energy device 12 stops supplying gaseous fuel, such that the air outlet holes 211 are blocked again to prevent the water from flowing back to the gas supply cavity 31, that is to say, the water is also prevented from flowing back to the supply pipe 13. The specific structure of the reset portion 33 is not limited, but may realize that when the pressure provided by the gaseous fuel disappears, the reset portion 33 may push the movable plugging portion 32 to the plugging position, thereby to block the air outlet holes 211. In some embodiments, the reset portion 33 is a spring, one end of the spring is against the inner wall of the gas supply cavity 31 on the side opposite to the supply pipe 13, and the other end of the spring is against the movable plugging portion 32.

Figure 2:
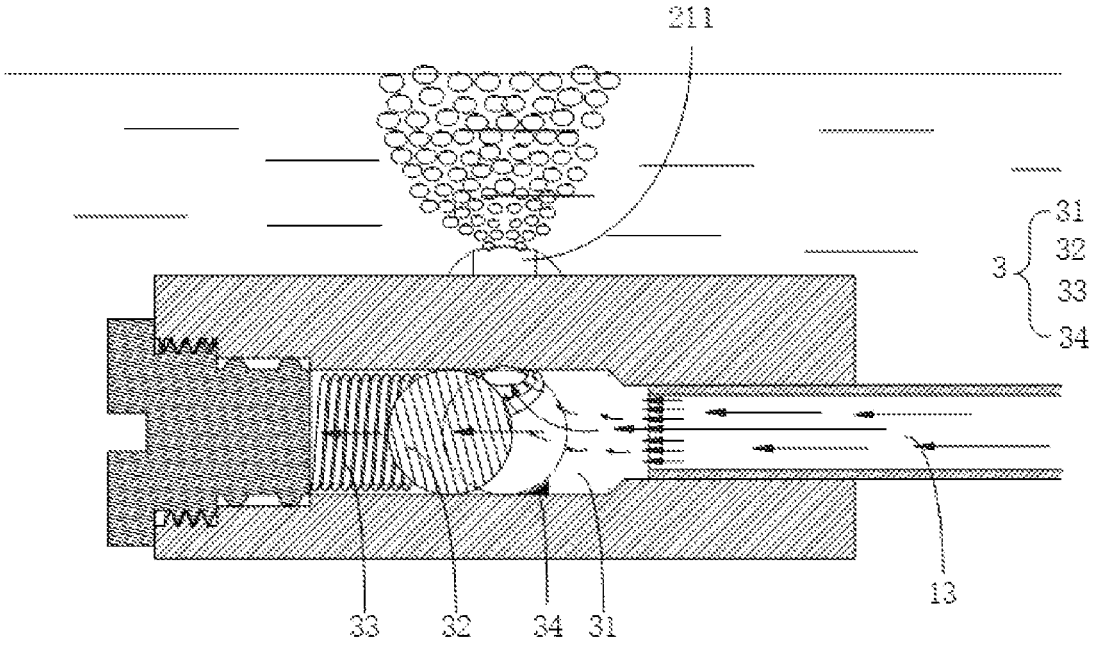
FIG. 2 is a schematic cross-sectional view of an anti-backflow structure in FIG. 1.

In order to make sure that the reset portion 33 may push the movable plugging portion 32 to accurately move to the plugging position in case of stopping gas fuel delivery. As shown in FIG. 2, the anti-backflow structure 3 further includes a limiting portion 34 provided inside the gas supply cavity 31 and located at the plugging position. The limiting portion 34 is configured to resist and restrict the movable plugging portion 32 at the plugging position when the reset portion 33 pushes the movable plugging portion 32 to move. The movable plugging portion 32 is limited at the plugging position, thereby to plug the air outlet holes 211. The specific structures of the movable plugging portion 32 and the limiting portion 34 are not limited. The structure of the limiting portion 34 is designed according to the specific structure of the movable plugging portion 32. In some embodiments, the movable plugging portion 32 is a rubber bulb, and the limiting portion 34 is a small projection provided on the bottom wall of the gas supply cavity 31 and under the corresponding air outlet holes 211, such that when the rubber bulb is moved below the air outlet holes 211, the small projection may press the rubber bulb to the plugging position.

In order to make the gaseous fuel have such a enough pressure to push the movable plugging portion 32 to move when the gaseous fuel is transported, the energy device 12 includes a high pressure gas-supply system communicated with the supply pipe 13 and configured to adjust the gaseous fuel, generally to reduce the pressure. Thus, the pressure of the gaseous fuel may be adjusted to a suitable range, such that the gas fuel can reach the desired rated pressure and can push the movable plugging portion 32 to move. Meanwhile, the problem of water flowing back during the discharge of the gaseous fuel may be solved when the gaseous fuel has a sufficient discharge rate from the air outlet holes 211, thereby to control the burning range of the gaseous fuel to some extent when the gaseous fuel escapes from the air outlet holes 211 to the water surface, which may improve the manageability of the combustion flame.

Figure 3:
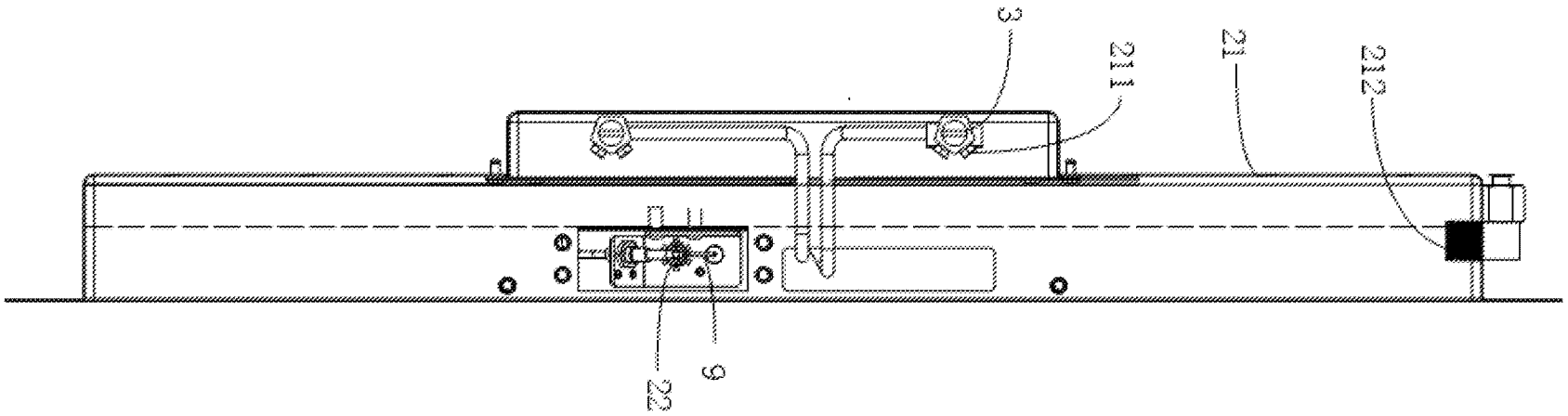
FIG. 3 is a schematic structural view of a water tank in FIG. 1.
Figure 4:
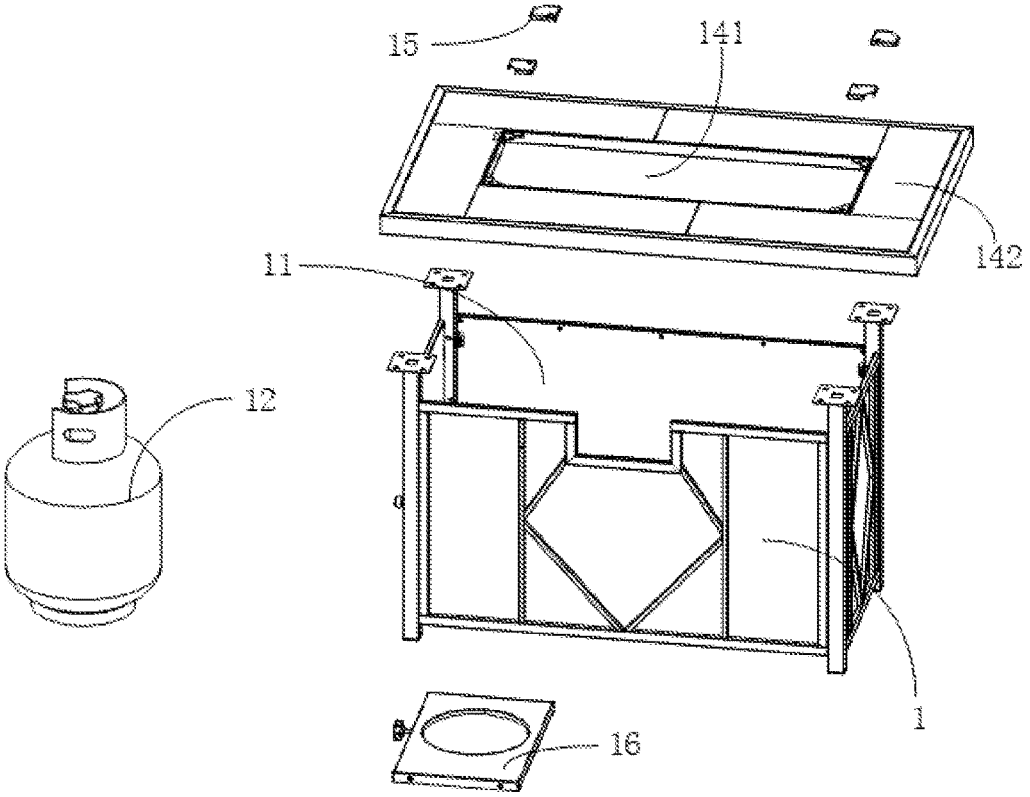
FIG. 4 is a stereoscopic disassembly view of a stove body in FIG. 1.

In order to avoid the water in the water tank 21 from interfering with the ignition of the gaseous fuel by the ignition portion 22, as shown in FIG. 1 and FIG. 3, the water tank 21 is defined with an overflow hole 212 configured to drain the water from the water tank 21 to an outside, thereby to control the water level height in the water tank 21. The height of the overflow hole 212 is less than the height of the ignition portion 22, thereby to prevent the water in the water tank 21 from entering into the ignition portion 22 and cause a safety problem. The bottom of the water tank 21 is provided with a drainage hole to facilitate water change.

Figure 5:
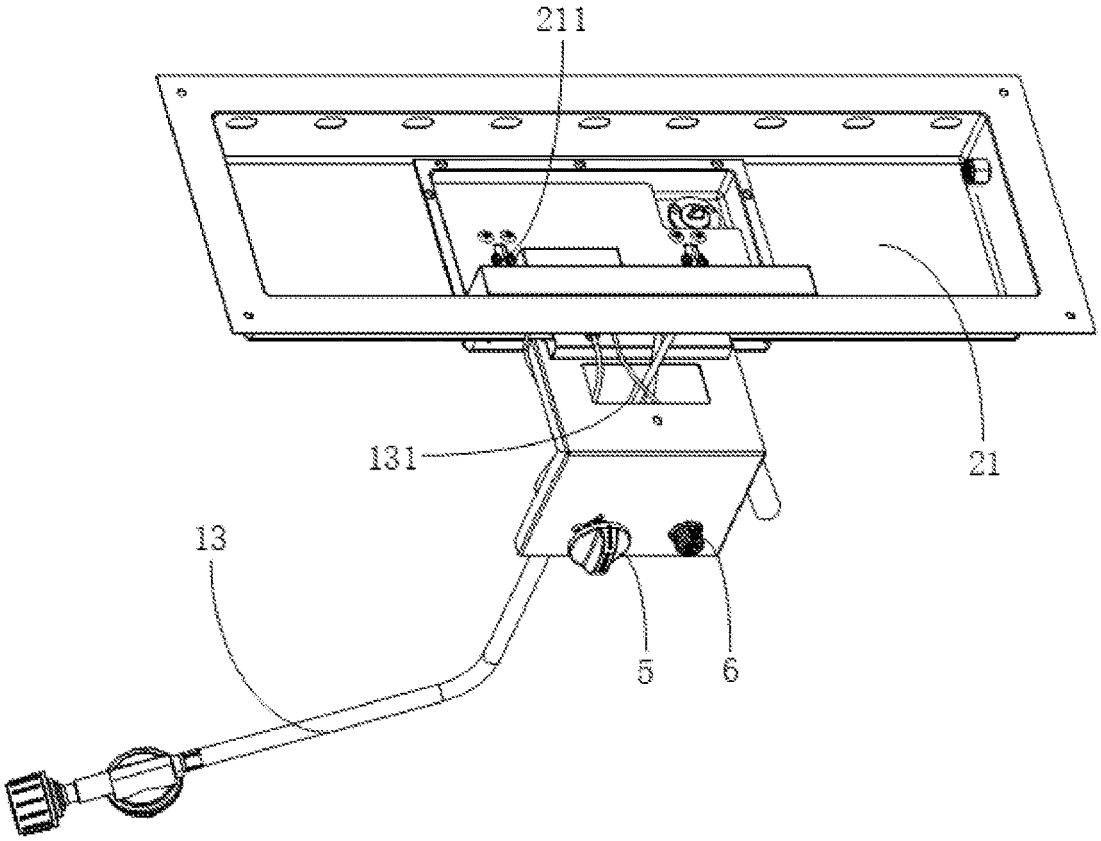
FIG. 5 is a location schematic view of a regulative switch and a pulse igniter in FIG. 1.
Figure 6:
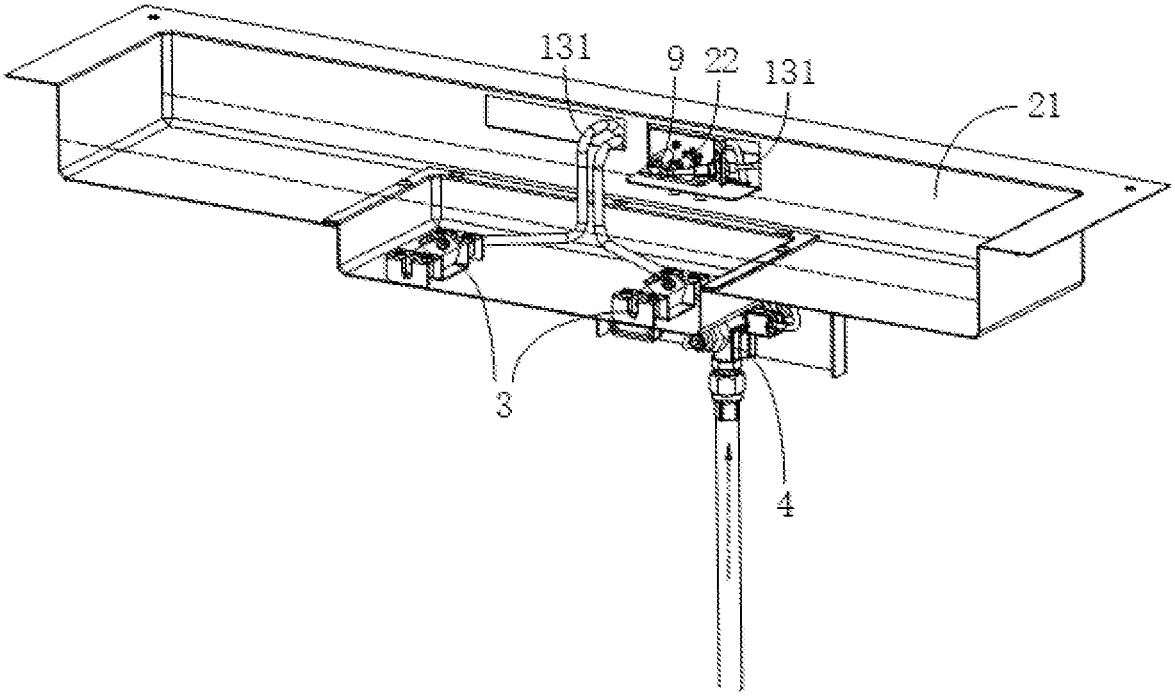
FIG. 6 is a distribution schematic view of supply branches in FIG. 1.

To specifically achieve ignition of the gaseous fuel escaping from the water surface by the ignition portion 22, the decorative gas stove 100 further includes a solenoid valve 4 provided on the supply pipe 13 for dividing the supply pipe 13 into a plurality of supply branches 131, and the ignition portion 22 is communicated with part of the supply branches 131. Thus, the gaseous fuel may be supplied to the ignition portion 22 through the supply branches 131. The decorative gas stove 100 also includes a pulse igniter 6. As shown in FIG. 3, FIG. 5 and FIG. 6, the pulse igniter 6 is similar to a battery box of a household gas stove. The pulse igniter 6 is used to provide current required for the ignition needle 9 mounted on the ignition portion 22. The ignition needle 9 is provided on the ignition portion 22 and extends to a location where the gaseous fuel escapes in the ignition portion 22, thereby to ignite the escaping gaseous fuel in the ignition portion 22 and to produce a flame to ignite the gas fuel escaping from the water surface. The ignition principle of the solenoid valve 4, the pulse igniter 6, the ignition needle 9 and the ignition portion 22 may refer to the cooktop of a household gas stove. In some embodiments of the present invention, the energy device 12 may be a gas cylinder. The cavity of the stove body 1 is provided with a corresponding installation seat 16 for the gas cylinder to be mounted in a restricted position. The installation seat 16 is defined with a hole corresponding to the shape of the gas cylinder bottom in the middle. The inner wall of the hole extends to the outside of the installation seat 16 to form a threaded hole, the gas cylinder bottom is locked by means of a bolt set in the threaded hole.

To achieve the adjustment of the size of the ornamental flame to produce different ornamental effects, as shown in FIG. 5, each of the air outlet holes 211 is respectively communicated with each of the supply branches 131 and the gaseous fuel can be delivered to the air outlet holes 211 by the supply branches 131. The decorative gas stove 100 further includes a regulative switch 5 configured to control the energy device 12 to output the gaseous fuel to each of the supply branches 131 for adjusting the amount of the gaseous fuel flowing from the air outlet holes 211 by controlling the number of the air outlet holes 211 for gas flowing, thereby to control the size of the flame by burning the gaseous fuel on the water surface. In some embodiments, a plurality of the air outlet holes 211 are divided into two groups, two groups of the air outlet holes 211 are communicated to different supply branches 131, and the regulative switch 5 allows for two levels of flame size adjustment. One level is a small flame when one of the air outlet holes 211 group is turned on to communicated with the corresponding supply branch 131 for delivery of gaseous fuel, and the other is a large flame when both of the air outlet holes 211 groups are simultaneously turned on to communicated with the corresponding supply branches 131 for delivery of gaseous fuel.

In order to install the water tank 21 on the stove body 1, as shown in FIG. 5, the stove body 1 further includes a storage table 14 provided at the upper end of the stove body 1 and a center of the storage table 14 is defined with an installation port 141. The water tank 21 is provided at the upper end of the stove body 1 by being installed in the installation port 141. A side of the storage table 14 is provided with a storage area 142. The storage area 142 is provided around the installation port 141 for placing objects.

To ensure the safety of viewing the water flames, and meanwhile to avoid affecting the viewing effect of the water flames, as shown in FIG. 1, the decorative gas stove 100 further includes a viewing glass 7 for firebreak provided on the storage table 14 and around the installation port 141. The viewing glass 7 is configured to insulate the fire and includes several pieces of glass and a glass assembly portion 71. The glass assembly portion 71 is provided between each two adjacent pieces of glass to assemble the four pieces of glass into one piece of glass. That is to say, the viewing glass 7 assembled surrounds the water tank 21 to prevent the flame produced in the water tank 21 from spreading outwardly, which may ensure personal safety when viewing the water flames. Because the glass is transparent, the impact on the viewing is small. The glass assembly portion 71 may fix the pieces of glass at periphery of the water tank 21, and the specific structure of the glass assembly portion 71 is not limited. In some embodiments, the glass assembly portion 71 includes a locking piece provided at the upper end and the lower end of the connection between two adjacent glasses, and two ends of the locking piece are attached to the surface of the glass. Both ends of the locking piece are provided with through holes, and the glasses are also provided with openings corresponding to the through holes, thereby the glasses are locked by screws. The number of glasses in the viewing glass 7 is not limited, and is generally set according to the shape of the water tank 21. In some embodiments, the side wall of the water tank 21 is rectangular, correspondingly, the viewing glass 7 includes four pieces of glass, which are assembled and connected to each other to form the viewing glass 7 of a rectangle, thereby to surround the side wall of the water tank 21.

In order to fix the water tank 21 at the installation port 141 and to define the installation position of the viewing glass 7 on the storage table 14, the storage table 14 is provided with a fixing block 15. The fixing block 15 is provided at intervals at the edge of the side wall of the water tank 21, to fix and lock the water tank 21 in the installation port 141, thereby to prevent accidents such as the water tank 21 falling out of the installation port 141. The viewing glass 7 is provided around the side wall of the water tank 21, such that the fixing block 15 may abut against the lower part of the viewing glass 7 at multiple positions on the edge of the side wall of the water tank 21, thereby to limit the installation position of the viewing glass 7. In some embodiments, the installation port 141 and the corresponding water tank 21 are rectangular. In order to fix the water tank 21 at the installation port 141, the four corners of the installation port 141 are respectively provided with the fixing block 15, and through holes are defined on the fixing block 15 and the water tank 21. By screws simultaneously passing through the through holes on the fixing block 15 and the water tank 21, the water tank 21 may be fixed at the installation port 141 by screws. Meanwhile, because the fixing block 15 is provided at the four corners of the water tank 21, the surface facing each glass of the fixing block 15 is set as a plane, thereby to simultaneously abut against and adhere to the surfaces of two adjacent glasses of the viewing glass 7, which may realize the limitation of the viewing glass 7.

Since the flame continues to burn, the temperature of the viewing glass 7 will increase, and it is difficult for the viewing glass 7 made of current materials to pass the temperature rise test and meet the safety regulations without affecting the viewing effect. A thermal insulation structure 8 is provided on a side of the viewing glass 7 away from the water tank 21, which is used to prevent people from burning caused by direct contact with the viewing glass 7 during viewing. In some embodiments of the present invention, the thermal insulation structure 8 may be wire mesh, and the diameter of the wire mesh may be relatively large, thereby to avoid affecting the viewing effect of the flame on the water as much as possible.

The above are only some embodiments of the present disclosure, and do not limit the scope of the present disclosure thereto. Under the concept of the present disclosure, equivalent structural transformations made according to the description and drawings of the present disclosure, or direct/indirect disclosure in other related technical fields are included in the scope of the present disclosure.

What is claimed is:

1. A decorative gas stove, comprising:

a stove body, comprising:

a cavity defined in the stove body;

an energy device provided inside the cavity, the energy device being configured to store gaseous fuel; and a supply pipe provided inside the cavity, the supply pipe being configured to transport the gaseous fuel;

a viewing platform, comprising:

a water tank provided on an upper end of the stove body, a bottom of the water tank being defined with a plurality of air outlet holes communicated with the supply pipe; and an ignition portion provided on a side wall of the water tank, the ignition portion being configured to ignite the gaseous fuel flowing to a water surface through the air outlet holes when the water tank is stored with water, wherein the water tank is defined with an overflow hole configured to drain the water from the water tank to an outside, and a height of the overflow hole is less than a height of the ignition portion;

a solenoid valve provided on the supply pipe for dividing the supply pipe into a plurality of supply branches, the ignition portion being communicated with part of the supply branches; and a pulse igniter configured to ignite the gaseous fuel flowing from the ignition portion.

2. The decorative gas stove of claim 1, further comprising:

an anti-backflow structure configured to prevent the water in the water tank from flowing back to the supply pipe, the anti-backflow structure comprising:

a gas supply cavity provided under the bottom of the water tank and communicated with the supply pipe and the air outlet holes;

a movable plugging portion provided inside the gas supply cavity and configured to move to a plugging position for plugging the air outlet holes and to move to an avoidance position for communicating the supply pipe and the air outlet holes, the movable plugging portion being pushed from the plugging position to the avoidance position by the gaseous fuel when the energy device outputs the gaseous fuel into the gas supply cavity; and a reset portion provided inside the gas supply cavity and opposite to the supply pipe, the reset portion being configured to push the movable plugging portion from the avoidance position to the plugging position when the energy device stops supplying gaseous fuel.

3. The decorative gas stove of claim 2, wherein the anti-backflow structure further comprises a limiting portion provided inside the gas supply cavity and located at the plugging position, and the limiting portion is configured to resist and restrict the movable plugging portion at the plugging position when the reset portion pushes the movable plugging portion to move.

4. The decorative gas stove of claim 2, wherein the energy device comprises a high pressure gas-supply system communicated with the supply pipe and configured to depressurize the gaseous fuel.

5. The decorative gas stove of claim 1, wherein:

each of the air outlet holes is respectively communicated with each of the supply branches, and the decorative gas stove further comprises a regulative switch configured to control the energy device to output the gaseous fuel to each of the supply branches for adjusting an amount of the gaseous fuel flowing from the air outlet holes.

6. The decorative gas stove of claim 1, wherein:

the stove body further comprises a storage table provided at the upper end of the stove body, a center of the storage table is defined with an installation port for installing the water tank, and a side of the storage table is provided with a storage area for placing objects.

7. The decorative gas stove of claim 6, wherein:

a viewing glass for firebreak is provided on the storage table and around the installation port, comprising:

four pieces of glass; and a glass assembly portion provided between each two adjacent pieces of glass to assemble the four pieces of glass into one piece of glass.

8. The decorative gas stove of claim 7, wherein:

a thermal insulation structure is provided on a side of the viewing glass away from the water tank; and/or a fixing block is provided on the storage table for fixing the water tank to the installation port, and the fixing block protrudes out of an upper end of the storage table and abuts a lower end of the viewing glass for restricting an installation position of the viewing glass.

* * * * *